US007428768B2

(12) United States Patent
Dingert

(10) Patent No.: US 7,428,768 B2
(45) Date of Patent: Sep. 30, 2008

(54) WIPING PLATE

(75) Inventor: Uwe Dingert, Absteinach (DE)

(73) Assignee: Carl Freudenberg KG, Weinheim (DE)

( * ) Notice: Subject to any disclaimer, the term of this patent is extended or adjusted under 35 U.S.C. 154(b) by 199 days.

(21) Appl. No.: 10/577,164

(22) PCT Filed: May 18, 2004

(86) PCT No.: PCT/EP2004/005352

§ 371 (c)(1),
(2), (4) Date: Apr. 26, 2006

(87) PCT Pub. No.: WO2005/051156

PCT Pub. Date: Jun. 9, 2005

(65) Prior Publication Data

US 2007/0056131 A1 Mar. 15, 2007

(30) Foreign Application Priority Data

Oct. 30, 2003 (DE) ..... 103 50 997

(51) Int. Cl.
*A47L 13/20* (2006.01)

(52) U.S. Cl. ..... 15/231; 15/144.1; 15/111

(58) Field of Classification Search ..... 15/228, 15/231, 111, 144.1, 147.2, 146
See application file for complete search history.

(56) References Cited

U.S. PATENT DOCUMENTS

| | | | | |
|---|---|---|---|---|
| 3,465,377 | A | 9/1969 | Thomas | |
| 4,852,210 | A | 8/1989 | Krajicek | |
| 5,937,471 | A * | 8/1999 | Liao | 15/111 |
| 6,098,239 | A | 8/2000 | Vosbikian | |
| 7,127,772 | B2 * | 10/2006 | Dingert et al. | 15/228 |
| 2002/0083542 | A1 * | 7/2002 | Hart | 15/210.1 |
| 2003/0084531 | A1 * | 5/2003 | Dingert et al. | 15/147.2 |
| 2007/0056131 | A1 * | 3/2007 | Dingert | 15/228 |

FOREIGN PATENT DOCUMENTS

| | | |
|---|---|---|
| DE | 724 147 | 8/1942 |
| DE | 197 13 709 A1 | 10/1998 |
| FR | 2 733 895 A1 | 11/1996 |

* cited by examiner

*Primary Examiner*—Lee D Wilson
(74) *Attorney, Agent, or Firm*—Leydig, Voit & Mayer, Ltd.

(57) ABSTRACT

A wiping plate (1) for accommodating a replaceable wiping cloth (2) is disclosed. The wiping plate (1) includes an essentially plate-shaped support plate (3) with an elastically resilient foam member (4) that can be fixed to the bottom face thereof. The foam member (4) is provided with at least one recess (5) inside which at least one non-elastic plug (6) is arranged. The at least one plug (6) is connected to the support plate (3) and has a length that is smaller than the height of the foam member (4) in the unstressed state. The plug (6) can at least be brought in contact with the side of the wiping cloth (2), which faces away from the wiping surface, by applying pressure to the support plate (3) and the compressed foam member (4).

17 Claims, 6 Drawing Sheets

WIPING PLATE

TECHNICAL AREA

Figure 1:
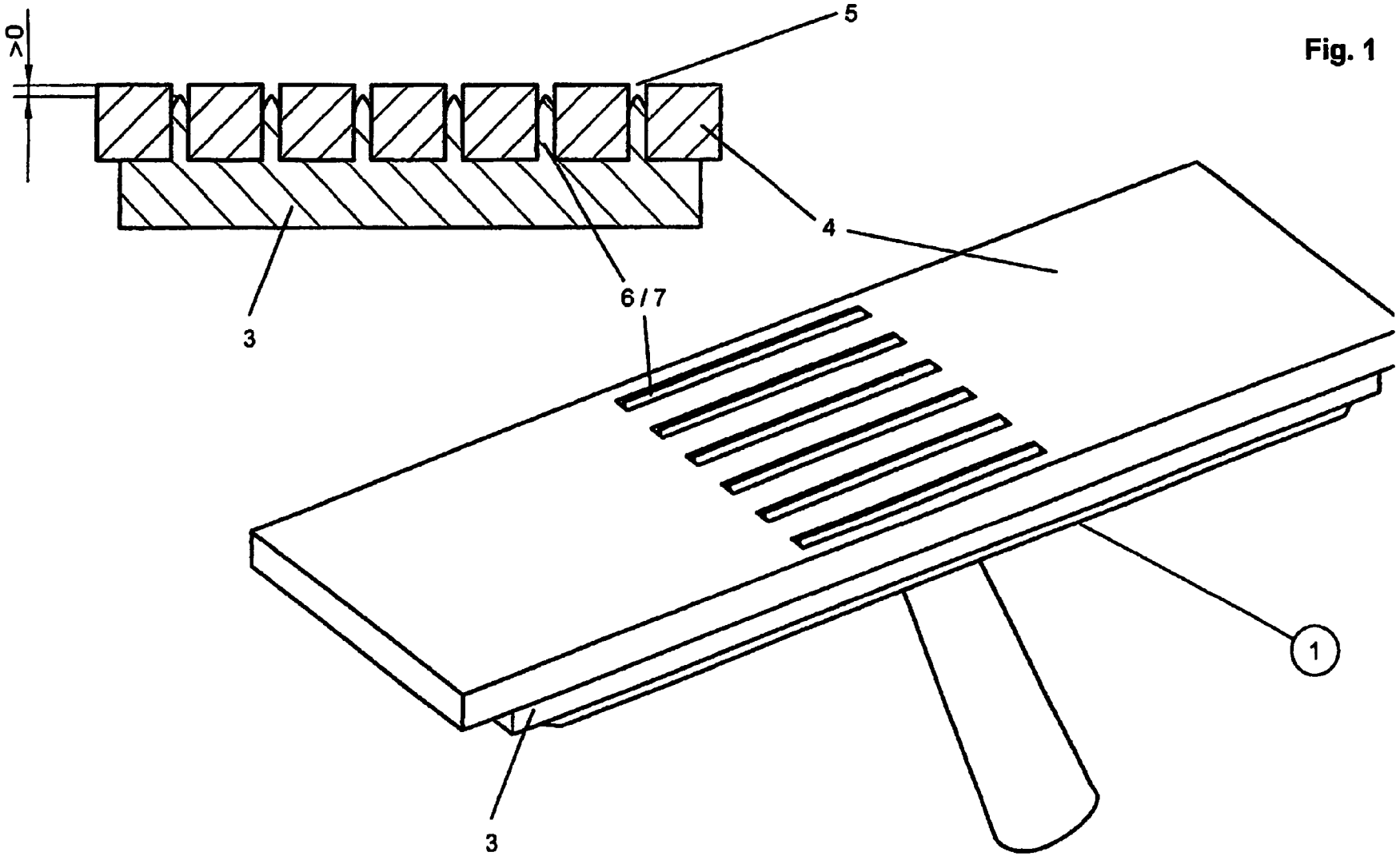

The invention concerns a wiper plate in accordance with the preamble of Patent Claim 1.

STATE OF THE ART

Dust wiping devices with a wiper plate covered with a wiping cloth, for example made of a nonwoven fabric, are known. They represent an alternative to known wet wiping devices with a wiping cover and are, in particular, intended for quick intermediate cleaning, in particular, for the elimination of dusty and fibrous impurities. The surface of these wiping cloths is made in such a way that it is suitable to take up dust and smaller particles and fibrous impurities. In addition to dry wiping cloths, moist cloths are also frequently used, which are soaked with a special cleaning liquid or can be soaked by a suitable device. For use, the wiping cloths are clamped over the underside of the wiper plate, facing the surface to be cleaned, and fixed on it by means of suitable affixing agents. Upon passing over the surface to be cleaned, dust, smaller particles, and fibers are caught on the wiping cloth. Since the wiping cloths are very thin, in contrast to the thick and absorbing wet wiping covers, providing the wiper plate underside with a plastic foam covering for the improvement of the wiping behavior is known. This plastic foam covering improves the absorption of particulate dirt on the wiping cloth surface and thus reduces the danger of scratching during the wiping process.

Firmly adhering local soiling can be detached and absorbed with these wiping devices only with great force expenditure.

From FR 2 733 895, a sponge with a multifunction structure is known. The previously known sponge comprises on the side facing the surface to be cleaned sections made of the sponge material and sections with an abrasively acting surface. The surface of the abrasively acting sections is located staggered upwards, in comparison to the sponge sections, so that the abrasive sections do not come into contact with the surface to be cleaned if no pressure is exerted on the sponge. By exerting pressure on the sponge, the sponge sections are compressed and the abrasively acting sections engage with the surface to be cleaned.

The abrasive sections consist of a firm and rough material. The cleaning action of the sponge results from the detachment of soilings by the abrasive sections and the absorption of the detached dirt particles by the sponge sections. The functioning principle of the abrasive material consists of the scouring effect of the rough surface.

The functioning principle of the sponge described above is not suitable for use in connection with cleaning cloths, since, on the one hand, the cleaning cloths quickly wear out due to the scouring sections and, on the other hand, the abrasively acting, scouring layer is ineffective due to the cleaning cloths, since the abrasive surface does not engage with the surface to be cleaned. The sponge sections cannot absorb dirt particles when cleaning cloths are used, since they also do not directly touch the surface to be cleaned.

DESCRIPTION OF THE INVENTION

The goal of the invention is to further develop the wiper plate described in the beginning, so that firmly adhering soilings can also be detached and absorbed.

This goal was attained, in accordance with the invention, with a wiper plate with the features of Claim 1.

The subordinate claims refer to advantageous developments.

To attain the goal, the foam body has at least one recess, in which at least one nonelastic punch connected to the carrier plate is located, which has a length that is equal to or smaller than the height of the foam body in an unused state, and the punch can be brought into contact at least with the side of the wiping cloth turned away from the wiping surface, by exerting pressure on the carrier plate and the compressed foam body.

The punches of the carrier plate do not exert a scouring action, but rather improve the wiping result with strong soiling only through a higher pressing force of the punch on the surface to be cleaned as a result of a smaller effective area. Therefore, it is not necessary to provide the abrasive area with a scouring surface, which would make the use of the wiper plate in connection with wiping cloths impossible. The wiping cloths need not be provided with a scouring surface either, for the aforementioned reason. The use of wiping cloths with a surface that scours at least in areas is not ruled out, however.

The punch can be 0 to 10 mm shorter than the height of the foam body in the unburdened state. With these distances, the use of the abrasively acting punch can be metered out with little force expenditure.

The ratio of the sum over all cross-sectional areas of the punches to the total area of the wiper plate can be between 1:10 and 1:100. With these area ratios, the effect of the punches is particularly good with a simultaneously large placement surface in the foam body in the unburdened state.

In an advantageous embodiment, the ratio can be 1:50. A ratio of 1:50 corresponds to the ratio of the sum of the cross-sectional areas of all bristles to the total cleaning area of a classic scrubber—that is, with the actuation of a structured functional surface, approximately the same pressing pressure is attained on the surface to be cleaned as with the use of a scrubber.

The punches can be uniform in material and connected in one piece with the carrier plate. The production of the wiping device is thus simple and low cost, since the number of manufacturing steps is reduced.

The punches can be connected to the carrier plate in a form- or material-locking manner. The configurations of the punches can be changed by the separate production of the punches and the carrier plate, without a change of the manufacturing mold for the wiper plate being required. During the manufacturing and later, it is possible to install various molds of punches.

In an advantageous embodiment of the invention, it is possible to design the punches as ribs, which extend in the longitudinal direction of the carrier plate. A linear pressing on the surface to be cleaned is attained by the ribs.

The ribs can extend over the entire width of the carrier plate. In this way, the entire longitudinal extension of the carrier plate can be used in an abrasively effective manner.

The ribs can extend over more than 50% of the longitudinal extension of the carrier plate. The abrasive effect by the greater pressing can be attained by a smaller effective area of the ribs.

The ribs can be situated at an angle, preferably approximately 45°, relative to the side edges of the wiper plate. In this way, a cleaning result can be attained, which is largely independent of the direction of movement of the wiper plate.

In another advantageous embodiment of the invention, the punches can be designed as rods which can be distributed uniformly over the entire underside or only partially in the area of the handle of the carrier plate. A point-like pressing on the surface to be cleaned is attained by the rod-like projections, which is advantageous on smaller surfaces, particularly with a great degree of soiling.

In an embodiment of the invention, the foam body can be made of a polymeric, organic material. Foams made of polymeric organic material do not absorb any moisture, whereby their characteristics remain the same with wet and dry cleaning.

The foam body can be formed by an open-pore foam. In this way, the foam body can store cleaning liquid, which can be released upon compressing the foam body on the wiping cloth.

The foam body can be provided with strips that protrude in an embossed manner, at least in a partial area of the surface of the foam facing the surface to be cleaned; these strips have areas with heights which differ from one another in the direction of their pattern. By means of the elevations, greater pressing forces are also produced, whereby the abrasive effect of the wiper plate is once more increased. By means of the elevations of the foam body, it is possible to implement a wiper plate with two zones with different magnitudes in their cleaning effects—on the one hand, the punches and, on the other hand, the elevations of the strips.

The surface of the wiper plate facing the surface to be cleaned can be curved in a convex manner. By means of the convex curvature, an absorption of the soiling is made possible over the entire area by the rolling of the wiper plate with a back and forth movement.

The carrier plate can be made of polymeric material. Elements of polymeric materials are simple to produce and polymeric materials are low-cost.

SHORT DESCRIPTION OF THE DRAWING

Figure 2:
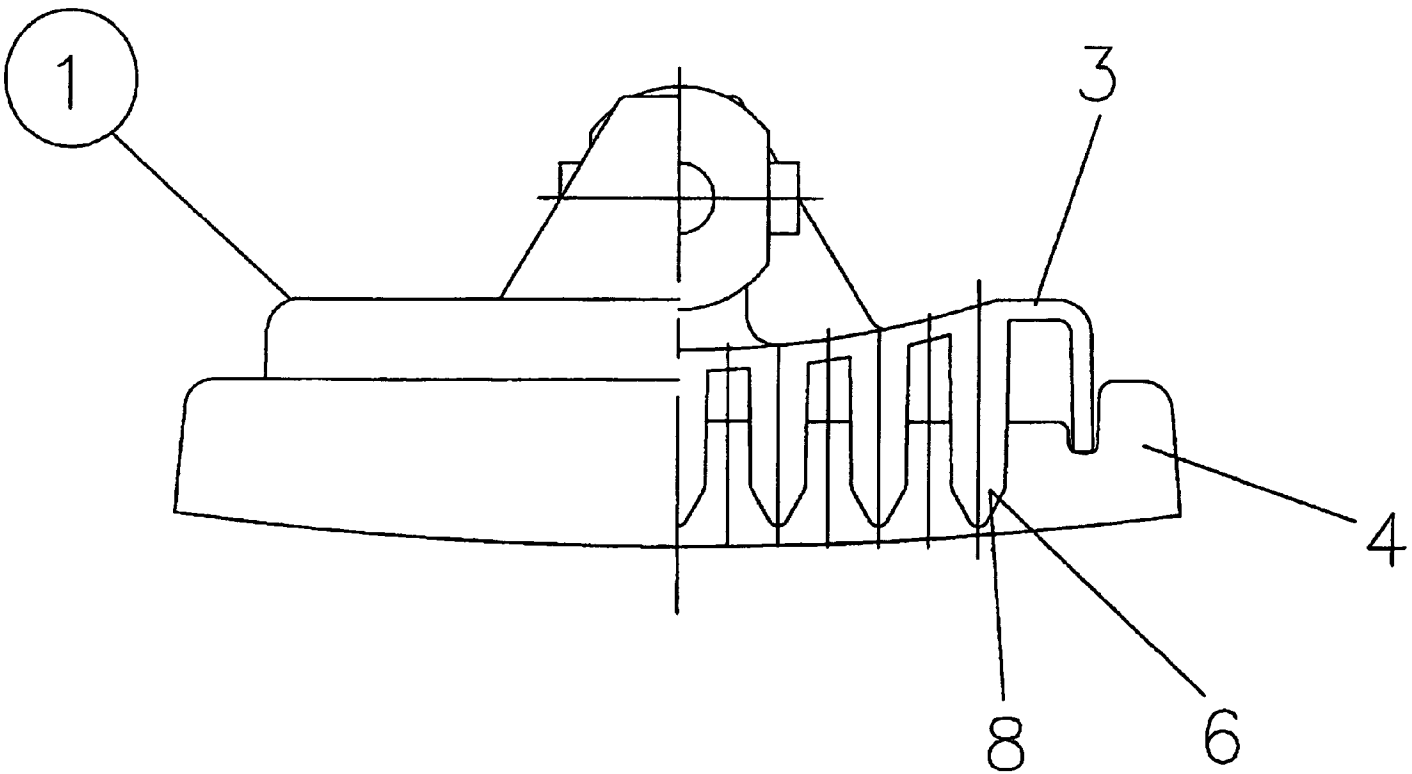
Figure 3:
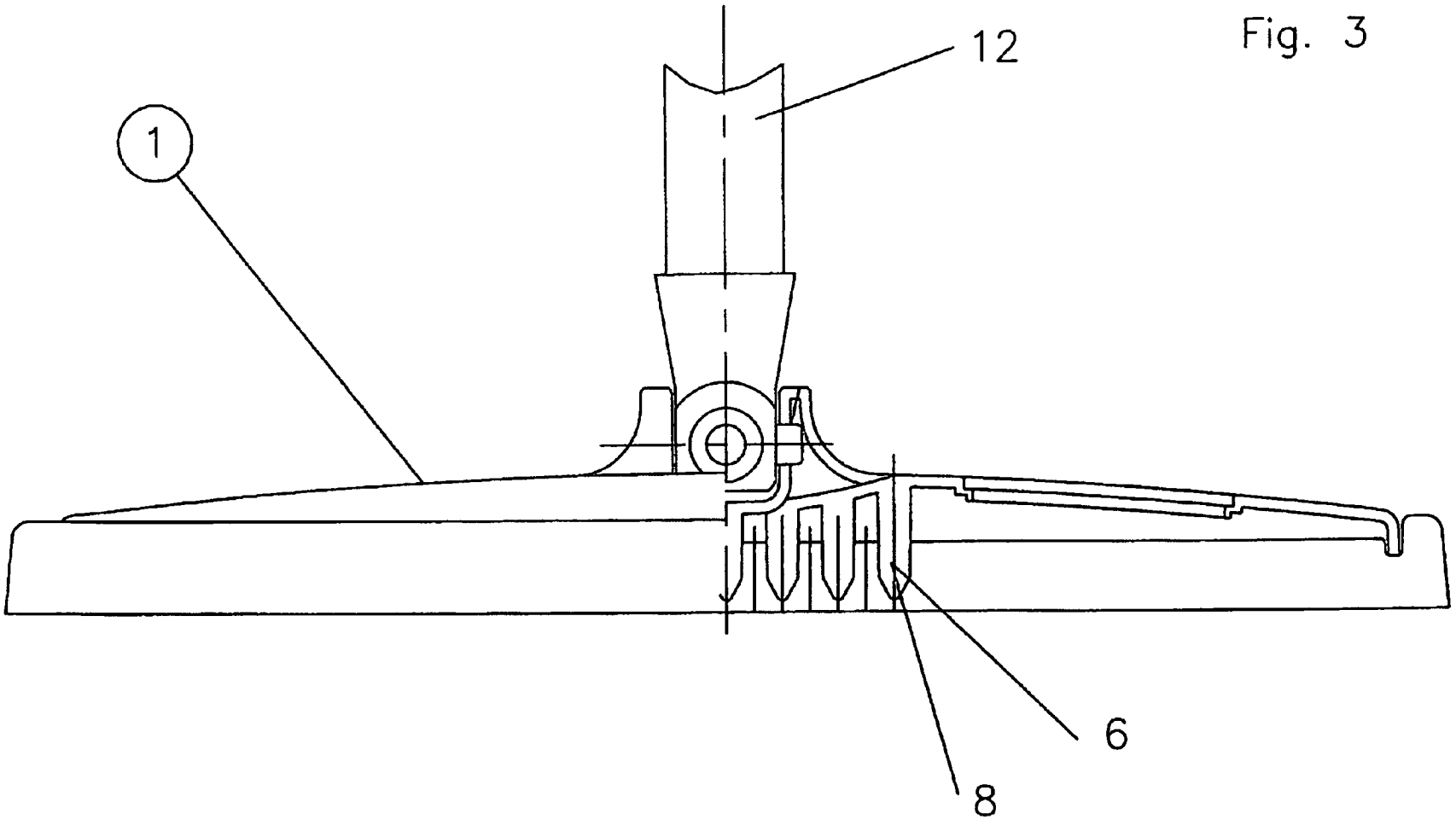
Figure 4:
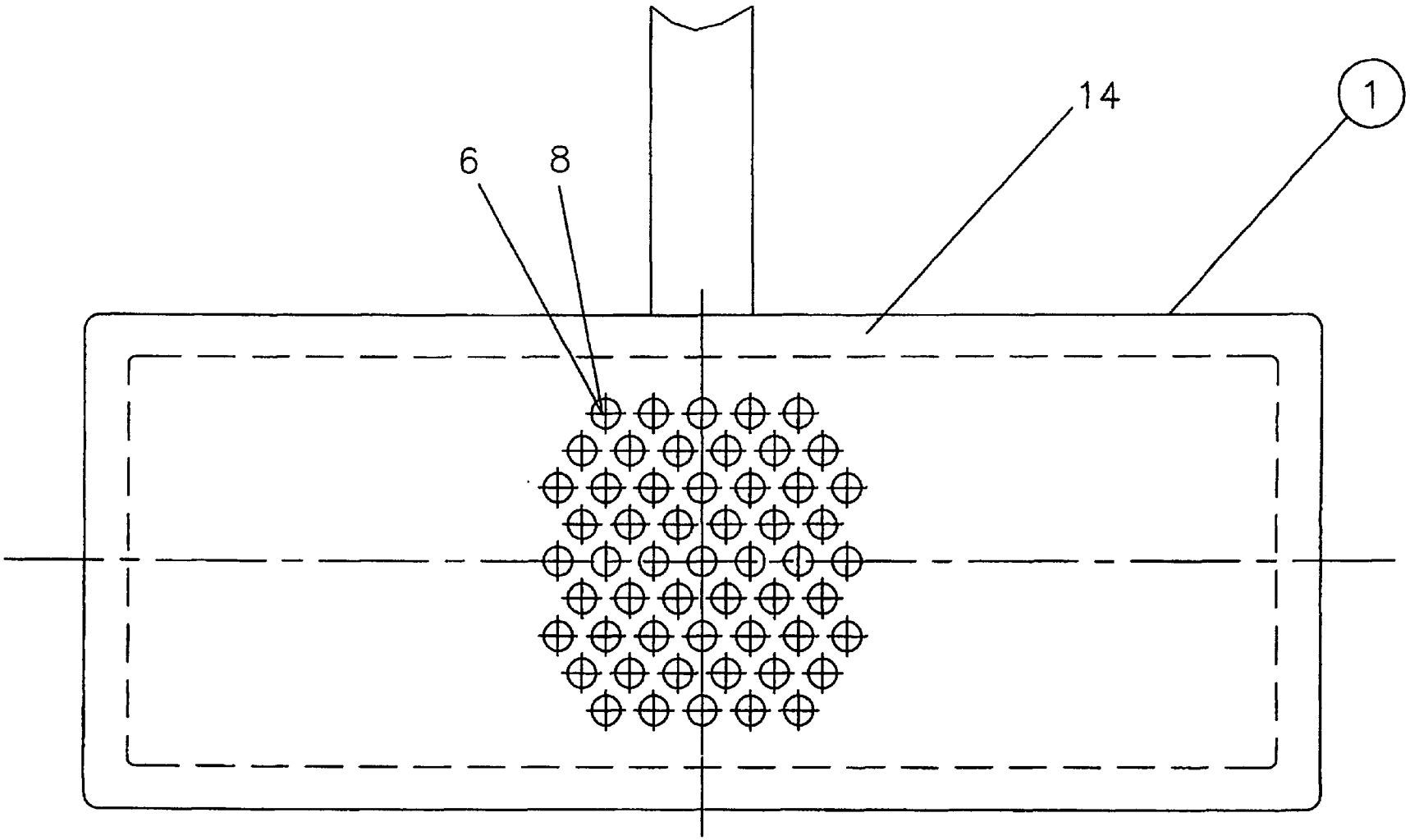
Figure 5:
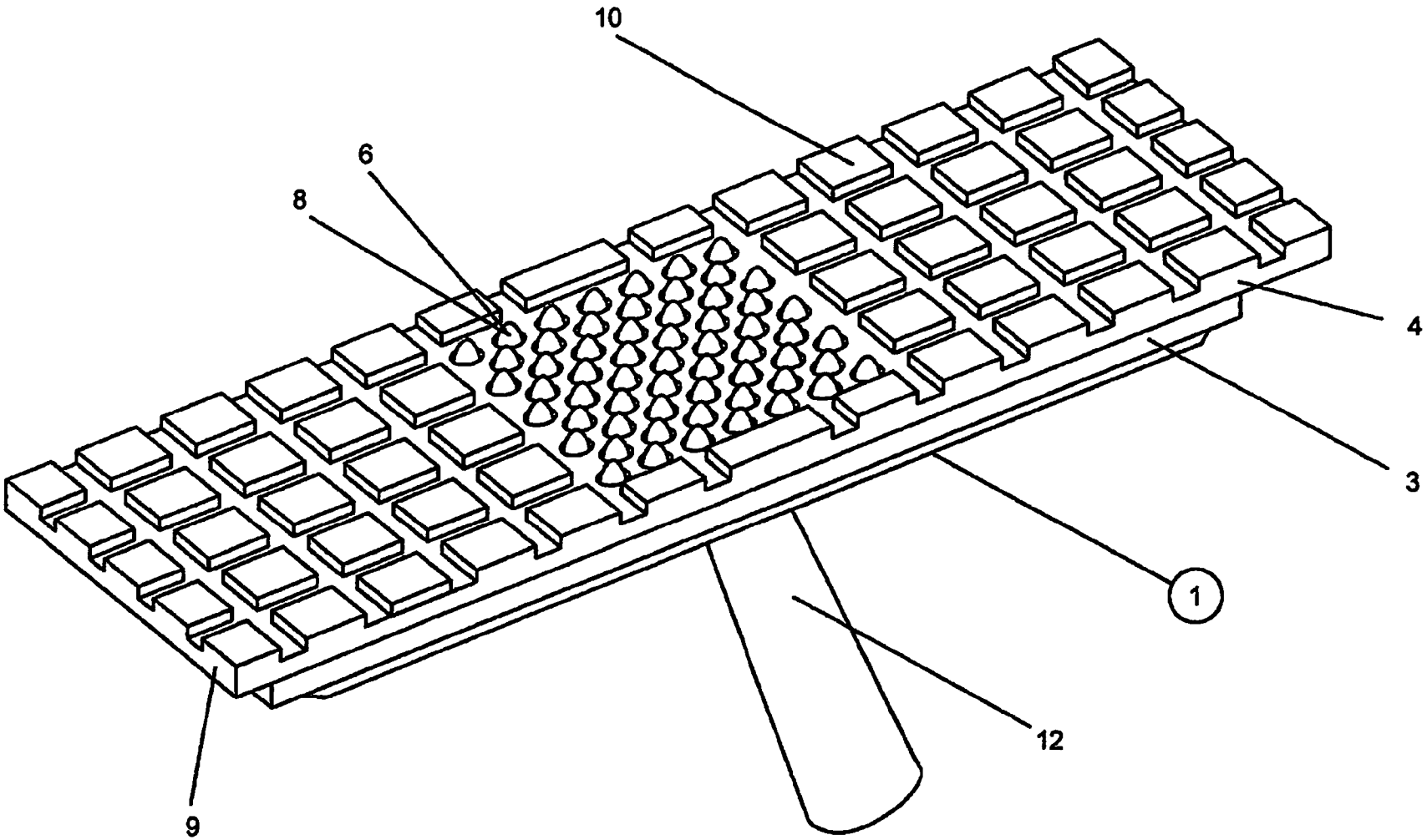
Figure 6:
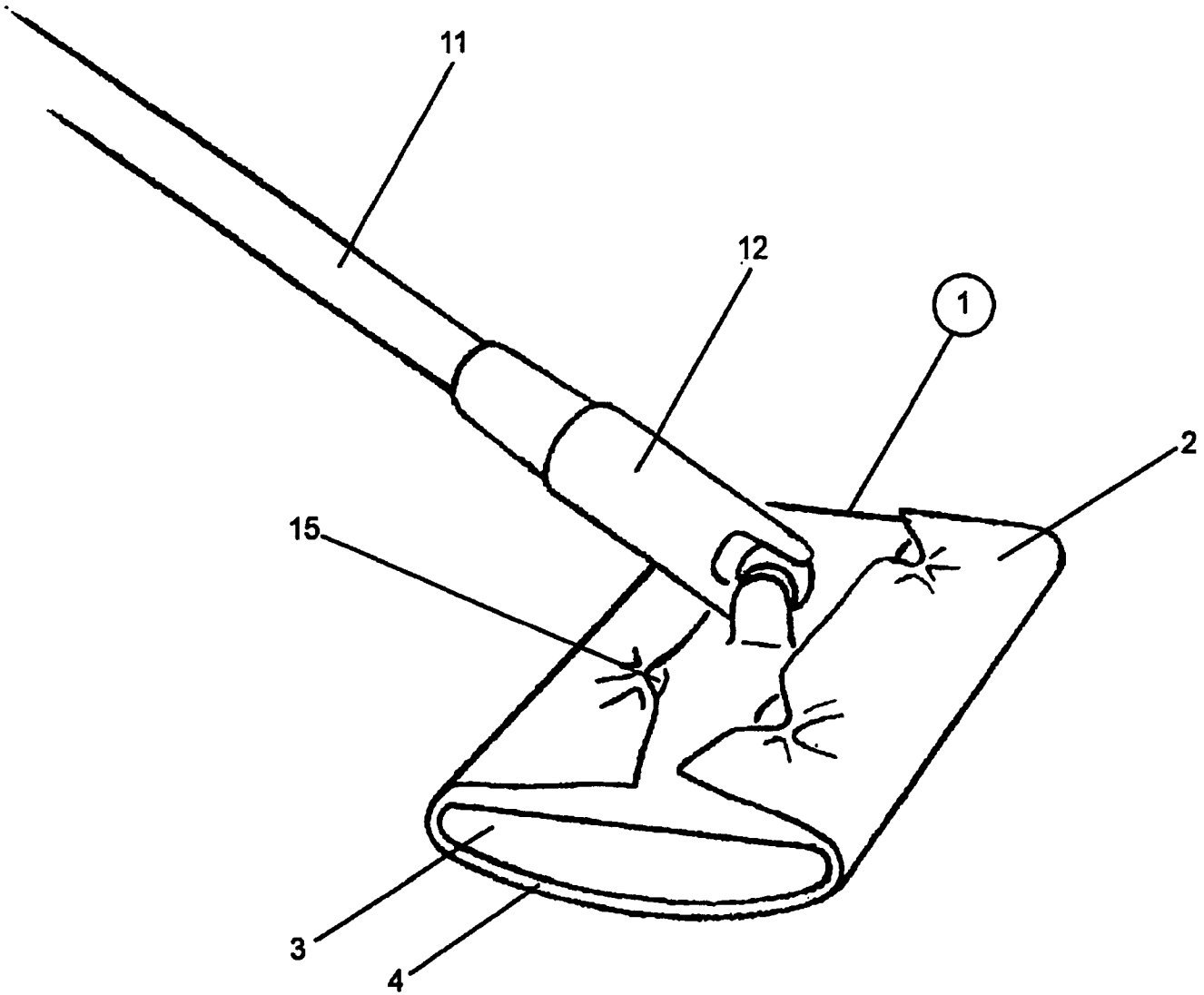

Some embodiment examples of the wiper plate, in accordance with the invention, are explained in more detail with the aid of the figures. In schematic representations, the figures show the following:

FIG. 1, a wiper plate with riblike punches in cross-section;

FIG. 2, a wiper plate, as a semi-sectional representation, in a side view, with rodlike punches;

FIG. 3, a wiper plate as a partial sectional representation in a front view;

FIG. 4, a wiper plate in a lower view;

FIG. 5, a wiper plate with a structured wiping surface in a perspective representation;

FIG. 6, a floor wiper with a wiper plate, in accordance with the invention, in a perspective representation.

EMBODIMENT OF THE INVENTION

FIG. 1 shows an embodiment example of the wiper plate 1, in accordance with the invention. The wiper plate 1 comprises a carrier plate 3 with punches 6, designed as one piece and uniform in material, constructed as ribs 7 in this embodiment example. A foam body 4 is affixed on the carrier plate 3 on the side facing the surface to be cleaned. The foam body 4 has recesses 5 into which the ribs 7 protrude. The ribs 7 are shorter in this embodiment than the height of the foam body 4, so that the punches 6 do not touch the surface to be cleaned in the unburdened state of the foam body 4. The ribs 7 extend over 90% of the width of the foam body 4 and are arranged in the area of the handle.

FIG. 2 shows a wiper plate 1 in which the carrier plate 3 and the foam body 4 have a convex curvature on the side facing the surface to be cleaned. The curvature extends, viewed in the direction of cleaning, between the back and the front edges of the carrier plate 3. The punches 6 are designed as rods 8 in this embodiment example. The rods 8 are uniform in material and are connected in one piece to the carrier plate 3. In the connecting area to the carrier plate 3, the rods 8 are formed in cylindrical shape and taper in the shape of a cone on the side facing the surface to be cleaned.

FIG. 3 shows the wiper plate 1 in the embodiment according to FIG. 2, in a front view. The punches 6 designed as rods 8 are placed in the area of the handle 12, symmetrical to the middle line.

FIG. 4 shows the wiper plate 1 in the embodiment according to FIG. 2 in a bottom view. The punches 6 designed as rods 8 are placed around the center of the wiper surface 14. In order to be able to attain an optimal cleaning result, the rods 8 are staggered. The ratio of the sum of the surfaces formed by the rods 8 and facing the surface to be wiped to the total surface of the wiping surface 14 is 1:20.

FIG. 5 shows a wiper plate 1 with a carrier plate 3 and a foam body 4. The foam body consists of an open-pore foam 9. The surface of the foam 9, facing the surface to be cleaned is provided with strips 10, which protrude, embossed, over the entire area and which have areas with heights which differ from one another. The punches 6 are designed as rods 8 in this embodiment, which are located in the area of the handle 12.

FIG. 6 shows a floor wiper 11 with a handle 12 and a wiper plate 1, in accordance with the invention, with a carrier plate 3 and a foam body 4. The wiper plate 1 is covered with a wiping cloth 2, which is fixed on the wiper plate 1 by means of soft clips 15.

The invention claimed is:

1. A wiper plate to hold a replaceable wiping cloth, comprising an essentially plate-shaped carrier plate, with an elastically yielding foam body, which can be affixed on the underside, the foam body (4) has at least one recess (5), in which at least one nonelastic punch (6) connected to the carrier plate (3) is located and has a height that is equal to or smaller than the height of the foam body (4) in the nonused state and in that the punch (6) can be brought into contact at least with the side of the wiping cloth (2) which is turned away from the wiping surface, by exerting pressure on the carrier plate (3) and the compressed foam body (4).

2. The wiper plate according to claim 1, characterized in that the punches (6) are 0 to 10 mm shorter than the height of the foam body (4) in the unburdened state.

3. The wiper plate according to claim 1, characterized in that the ratio of the cross-sectional area of the punches (6) to the total area of the wiper plate (1) is between 1:10 and 1:100.

4. The wiper plate according to claim 3, characterized in that the ratio is 1:50.

5. The wiper plate according to claim 1, characterized in that the punches (6) are uniform in material and are connected in one piece to the carrier plate (3).

6. The wiper plate according to claim 1, characterized in that the punches (6) are connected, in a form- or material-locking manner, to the carrier plate (3).

7. The wiper plate according to claim 1, characterized in that the punches (6) comprise ribs (7), which extend in the longitudinal direction of the carrier plate (3).

8. The wiper plate according to claim 1, characterized in that the ribs (7) extend over the entire width of the carrier plate (3).

9. The wiper plate according to claim 1, characterized in that the ribs (7) extend more than 50% of the longitudinal extension of the carrier plate (3).

10. The wiper plate according to claim 1, characterized in that the ribs (7) are situated at an angle, preferably approximately 45°, relative to the side edges of the wiper plate (1).

11. The wiper plate according to claim 1, characterized in that the punch (6) comprises rods (8).

12. The wiper plate according to claim 1, characterized in that the foam body (4) is made of a polymeric, organic material.

13. The wiper plate according to claim 1, characterized in that the foam body (4) is formed by an open-pore foam (9).

14. The wiper plate according to claim 1, characterized in that the surface of the foam body (4), which faces the surface to be cleaned, is provided with strips that protrude, embossed, at least in one partial area and that have areas with heights which differ from one another in the direction of their pattern.

15. The wiper plate according to claim 1, characterized in that the area of the wiper plate (1), which faces the surface to be cleaned, has a convex curvature.

16. The wiper plate according to claim 1, characterized in that the carrier plate (3) is made of polymeric material.

17. A floor wiper (11) with a wiper plate (1) to hold a replaceable wiping cloth (2), wherein the wiper plate (1) can be connected to a handle (12), the wiper plate (1) comprising an essentially plate-shaped carrier plate, with an elastically yielding foam body, which can be affixed on the underside, the foam body (4) has at least one recess (5), in which at least one nonelastic punch (6) connected to the carrier plate (3) is located and has a height that is equal to or smaller than the height of the foam body (4) in the nonused state and in that the punch (6) can be brought into contact at least with the side of the wiping cloth (2) which is turned away from the wiping surface, by exerting pressure on the carrier plate (3) and the compressed foam body (4).

* * * * *